US012545537B2

(12) United States Patent
Onecha et al.

(10) Patent No.: US 12,545,537 B2
(45) Date of Patent: Feb. 10, 2026

(54) MEDIA BYPASS FOR A PRINTER

(71) Applicant: Hewlett-Packard Development Company, L.P., Spring, TX (US)

(72) Inventors: Javier Onecha, Sant Cugat del Valles (ES); Ricardo Sanchis Estruch, Sant Cugat del Valles (ES); Eduardo Martin Orue, Sant Cugat del Valles (ES); Marc Garcia Lleixa, Sant Cugat del Valles (ES); Isidoro Maya Agudo, Sant Cugat del Valles (ES)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 55 days.

(21) Appl. No.: 18/247,142

(22) PCT Filed: Sep. 30, 2020

(86) PCT No.: PCT/US2020/053498
§ 371 (c)(1),
(2) Date: Mar. 29, 2023

(87) PCT Pub. No.: WO2022/071939
PCT Pub. Date: Apr. 7, 2022

(65) Prior Publication Data

US 2023/0373741 A1 Nov. 23, 2023

(51) Int. Cl.

| | |
|---|---|
| ***B65H 11/02*** | (2006.01) |
| ***B65H 1/04*** | (2006.01) |
| ***B65H 5/26*** | (2006.01) |

(52) U.S. Cl.
CPC ..... *B65H 5/26* (2013.01); *B65H 2404/63* (2013.01); *B65H 2405/324* (2013.01)

(58) Field of Classification Search
CPC ..... B65H 5/26; B65H 2405/324; B65H 2404/63; B65H 2404/691; B65H 5/38; B65H 2407/21; B65H 1/04; B65H 3/44; B41J 13/103; G03G 15/6514; G03G 2215/00392
See application file for complete search history.

(56) References Cited

U.S. PATENT DOCUMENTS

| | | | |
|---|---|---|---|
| 5,746,528 | A | 5/1998 | Mayer et al. |
| 7,744,210 | B2 | 6/2010 | Verhoest et al. |
| 7,997,677 | B2 | 8/2011 | Navazo et al. |
| 8,146,913 | B1 | 4/2012 | Blair et al. |
| 8,721,067 | B2 | 5/2014 | Kobayashi et al. |
| 9,586,416 | B2 | 3/2017 | Yosefi et al. |
| 9,815,308 | B2 | 11/2017 | Andrea Tallada et al. |

(Continued)

FOREIGN PATENT DOCUMENTS

| | | | |
|---|---|---|---|
| CN | 101566810 | A | 10/2009 |
| CN | 208569303 | U | 3/2019 |

(Continued)

*Primary Examiner* — Luis A Gonzalez
(74) *Attorney, Agent, or Firm* — Jordan IP Law, LLC

(57) ABSTRACT

A media bypass for a printer, the media bypass comprising a convertible media support to hold a substrate and to switch between an active and an inactive configuration, wherein the convertible media support pivots from the inactive configuration towards the active configuration to extend into the printer and to guide the substrate into the printer.

9 Claims, 10 Drawing Sheets

(56) References Cited

U.S. PATENT DOCUMENTS

| | | | | |
|---|---|---|---|---|
| 2003/0080496 | A1 | 5/2003 | Siow et al. | |
| 2005/0046685 | A1 | 3/2005 | Silverbrook | |
| 2009/0267283 | A1 | 10/2009 | Mizuguchi | |
| 2019/0086853 | A1 | 3/2019 | Oshida | |
| 2021/0155432 | A1* | 5/2021 | Okazaki | B65H 1/04 |
| 2021/0198064 | A1* | 7/2021 | Sasaki | H04N 1/00519 |
| 2022/0041395 | A1* | 2/2022 | Oshiro | B65H 1/14 |

FOREIGN PATENT DOCUMENTS

| | | | | |
|---|---|---|---|---|
| JP | 07097102 | A | * | 4/1995 |
| JP | 08104449 | A | * | 4/1996 |
| JP | 2002-301842 | A | | 10/2002 |
| JP | 2008-201107 | A | | 9/2008 |
| JP | 2017039582 | A | * | 2/2017 |
| WO | 2006/120166 | A1 | | 11/2006 |

* cited by examiner

MEDIA BYPASS FOR A PRINTER

BACKGROUND

Printers can be used to generate predefined structures by depositing a printing fluid, such as an ink, on a substrate. The geometry of the structure can be defined by a relative movement between a printhead ejecting the printing fluid and a substrate holder.

Most printers feature an internal media supply to internally store the substrate and to supply the substrate to the printhead via an internal transport mechanism, such as a combination of rolls, conveyor belts, suction devices or movable supports. Flexible substrates can be transported through the printer on a winding path to reduce the size of the printer.

BRIEF DESCRIPTION OF THE DRAWINGS

The following detailed description will best be understood with reference to the drawings, wherein:

FIG. 100 and FIG. 10D illustrate detail views of the coupling mechanism in the examples of FIGS. 9A, 9B.

DETAILED DESCRIPTION

Figure 1:
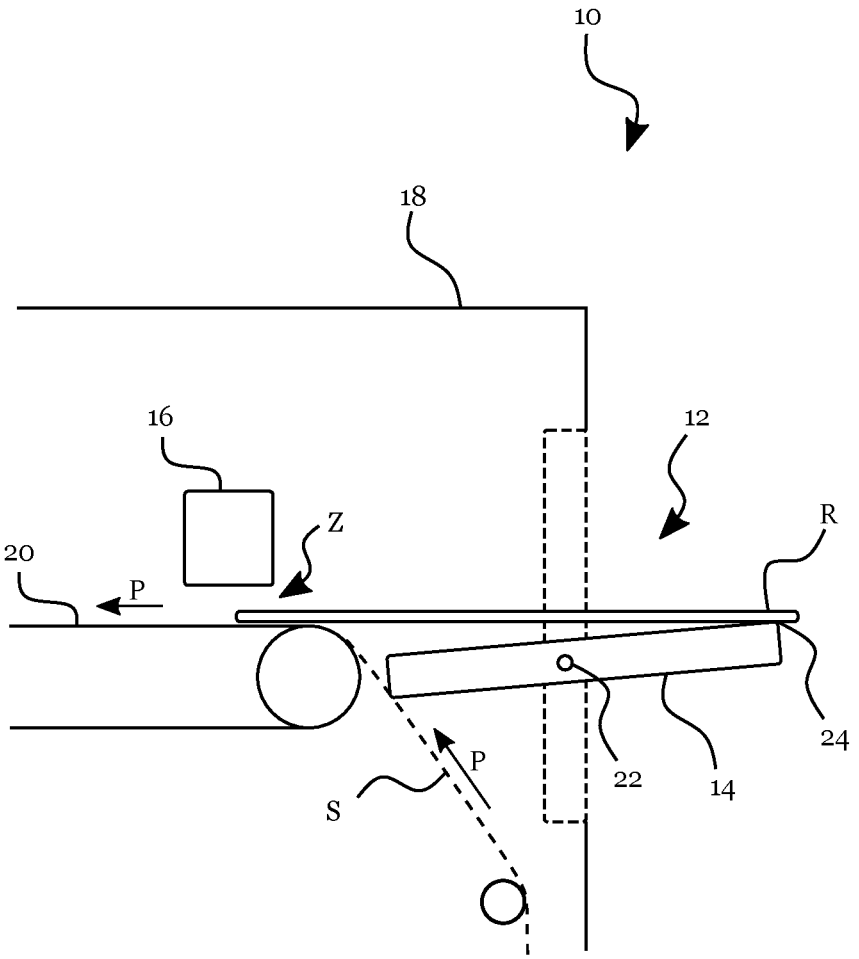
FIG. 1 schematically illustrates a printer for printing on different types of substrates with a media bypass according to an example.

FIG. 1 schematically illustrates a printer 10 for printing on two different types of media, e.g., flexible (S) and rigid (R) substrates S, R, with a media bypass 12 for receiving rigid or flexible substrates S, R, according to an example. The media bypass 12 comprises a convertible media support 14 to switch between an active and an inactive configuration (illustrated in solid and dashed lines, respectively), and to guide an externally supplied flexible or rigid substrate S, R into the printer 10 in the active configuration. A printhead 16 is arranged inside of a frame 18 of the printer 10 and positioned to face a print zone Z of a media path P of to print on the substrate S, R which may be supported on a media transport mechanism, e.g. a conveyor belt 20.

In the inactive configuration, the convertible media support 14 may be flush with a frame 18 of the printer 10 and define a portion of the periphery of the printer 10. A flexible substrate S may be internally supplied via an internal media supply (not shown), such as a media roll or a sheet tray, and may be supplied towards the conveyor belt 20 along a winding portion of the media path P from above or below the conveyor belt 20.

The substrate S supplied from the internal media supply may be any substrate S on which a printing material can be applied. The substrates S may have physical properties similar to a sheet of paper; however, any suitable substrate S may be used. For example, the substrate S may be or comprise paper and/or paper-based material, such as cardboard, textiles, leather, polymers, and/or combinations thereof, etc. The substrate S supplied from the internal media supply in the form of a sheet or roll may be transparent, semi-transparent or light absorbing, and the dimensions of the substrate S may generally be selected from a wide range of thicknesses, widths or lengths.

The substrate S, R supplied via the media bypass 12 may also be any substrate S, R on which a printing material can be applied, e.g. a flexible substrate supplied via an external roll or as flexible sheets as described above, but may further comprise rigid substrates R which may be supplied past the printhead 16 along a substantially linear path. A substrate S, R may be considered rigid when it is incompatible with a winding media path P from the internal media supply towards the printhead 16, e.g. when a stiffness of the substrate S, R prevents the substrate S from following an imposed curved path from the internal media supply towards the printhead 16.

The printhead 16 may eject a printing material, such as a printing fluid or a build material, onto the substrate S, R. The printing material for printing on the substrate S, R may be any appropriate material suitable to generate a printed image or shaped element on the substrate S, R, such as by means of ink. The printed image and/or shaped element may be or comprise text, lines, shapes, letters, numerals, signs, symbols or a combination of these in an arbitrary color, alignment or shape. The printhead 16 can be mounted on a displacement assembly allowing the relative displacement of the printhead 16 and the conveyor belt 20 along linear or complex paths, or the printhead 16 may extend over the width of the substrate S, R, and may feature a plurality of nozzles to control a deposition process of the printing material over the width of the substrate S, R while the substrate S, R may be advanced along the media path P.

The advance of the substrate S, R may be controlled by an internal transport mechanism, such as the conveyor belt 20, during the deposition process. In the print zone Z beneath or close to the printhead 16, a position or flatness of the substrate S, R may be adjusted by means of a vacuum source (not shown) acting on the substrate S. For example, a vacuum chamber (not shown) may be connected to supporting structures in the print zone Z to act on the substrate S, R, e.g. via openings in the conveyor belt 20 facing the printhead 16.

To accommodate substrates S, R of different thickness, such as a thickness varying by more than 5 mm or more than 10 mm, the distance between a supporting structure in the media path P and the printhead 16 may be adjusted, e.g. by adjusting a vertical position of the conveyor belt 20.

The convertible media support 14 can pivot from the inactive configuration towards the active configuration to extend into the printer 10 and to guide a substrate R, S into the printer 10. The convertible media support 14 may provide a media support 14 extending from a point outside of the frame 18 of the printer 10 into the printer 10, such as to facilitate externally supplying rigid and substrates S, R into the internal media path P by an operator. In some examples, the convertible media support 14 bridges a gap between the periphery of the printer 10 and an internal media path P.

The convertible media support 14 may be pivotable about a pivot point 22 close to a center of mass of the convertible media support 14. The center of mass of the convertible media support 14 may lie outside of the periphery of the printer 10 in the active configuration of the media bypass 12, such as to bias the convertible media support 14 towards the active configuration by its own weight.

The convertible media support 14 may be held in the inactive configuration via a retainer (not shown), such as a mechanical locking pin or a magnet to prevent inadvertent switching from the inactive configuration towards the active configuration. In other words, the retainer may selectively prevent switching from the inactive configuration towards the active configuration or may provide a force threshold for switching from the inactive configuration towards the active configuration.

In the active configuration, the media bypass 12 may guide flexible or rigid substrates S, R into the printer 10 and into the media path P. In some examples, the convertible media support 14 guides externally supplied substrates S, R into an intermediate section of the media path P for substrates S supplied from an internal media supply. In some examples, the convertible media support 14 is to guide flexible and rigid substrates S, R into the printer 10. For example, the convertible media support 14 may be aligned with the printhead 16 in an active configuration, such that flexible or rigid substrates S, R can be externally supplied into the printer 10 along a substantially linear path past the printhead 16. The media bypass 12 may be level with respect to media support structures facing the printhead 16, such that rigid substrates R supported by the convertible media support 14 are level with respect to the portion of the media path P past the printhead 16 in the print zone Z.

The convertible media support 14 may be arranged to support a rigid or flexible substrate R, S on an outer edge 24 of the convertible media support 14. The outer edge 24 may lie outside of the printer 10 in the active configuration and the convertible media support 14 may be inclined with respect to a media path P past the printhead 16. Flexible substrates S supported on the outer edge 24 of the convertible media support 14 may bend into the media path P, such that the flexible substrate S may be suspended substantially on the outer edge 24 of the convertible media support 14, and may not follow an outline of the convertible media support 14. Hence, the outer edge 24 of the inclined convertible media support 14 may act as a fulcrum to balance restoring forces of the flexible substrate S supported on the outer edge 24 and may thereby prevent the substrate S from falling out of the printer 10.

The outer edge 24 of the inclined convertible media support 14 may be level with respect to the print zone Z, such that a rigid substrate S may be supported on the outer edge 24 of the convertible media support 14 and on portions of an internal transport mechanism of the printer 10, such as on the conveyor belt 20. In other words, the outer edge 24 of the convertible media support 14 may define an external support of a substantially linear path into the printer 10 and past the printhead 16 for rigid substrates R.

In some examples, the inclination of the convertible media support 14 is adjustable such that rigid substrates R of different thickness supported by the convertible media support 14 can be level with respect to the print zone Z defined by the section of the media path P past the printhead 16.

For example, an actuator may pivot the convertible media support 14 based on a media thickness setting of the printer 10, such that a rigid substrate R of corresponding thickness and supported on the outer edge 24 of the convertible media support 14 is level with respect to the media path P past the printhead 16.

In some examples, the convertible media support 14 may be biased by an elastic biasing element to assume a first configuration in the absence of external forces and to pivot towards a second configuration when a force is applied to the convertible media support 14. For example, the inclination of the convertible media support 14 may be passively adjusted based on a torque exerted onto the convertible media support 14, e.g. to pivot in response to an increased weight of a thicker rigid substrate S, R. The restoring force of the elastic biasing element may be selected, such that the inclination of convertible media support 14 is changed when the weight of the substrate S, R is greater than a predetermined weight threshold. The weight threshold may correspond to the weight of a reference substrate S,R of a predetermined thickness, e.g. a 5 mm or 10 mm rigid substrate R made of a reference material.

In the absence of external forces, the convertible media support 14 may extend towards a curving section of the conveyor belt 20 in the active configuration, e.g. towards an edge of the conveyor belt 20, such that substrates S, R supplied via the media bypass 12 abut against the curving section and may be guided onto the conveyor belt 20 by the movement of the conveyor belt 20 along the curving section.

When external forces act on the convertible media support 14, the convertible media support 14 may pivot to lie parallel with an internal transport mechanism of the printer 10 for a maximum thickness setting.

Hence, the media bypass 12 may be brought into the active configuration to externally supply flexible and rigid substrate S, R into the media path P of a printer 10 with an internal media storage, such as for supplying rigid or sheet substrates S, R into an intermediate section of the media path P of a printer 10 with an internal roll or flexible sheet media supply for flexible substrates S. By adjusting the inclination of the convertible media support 14, the media bypass 12 may guide flexible or rigid substrates S, R of varying thickness along a linear path into the printer 10 and past the printhead 16.

Figure 2:
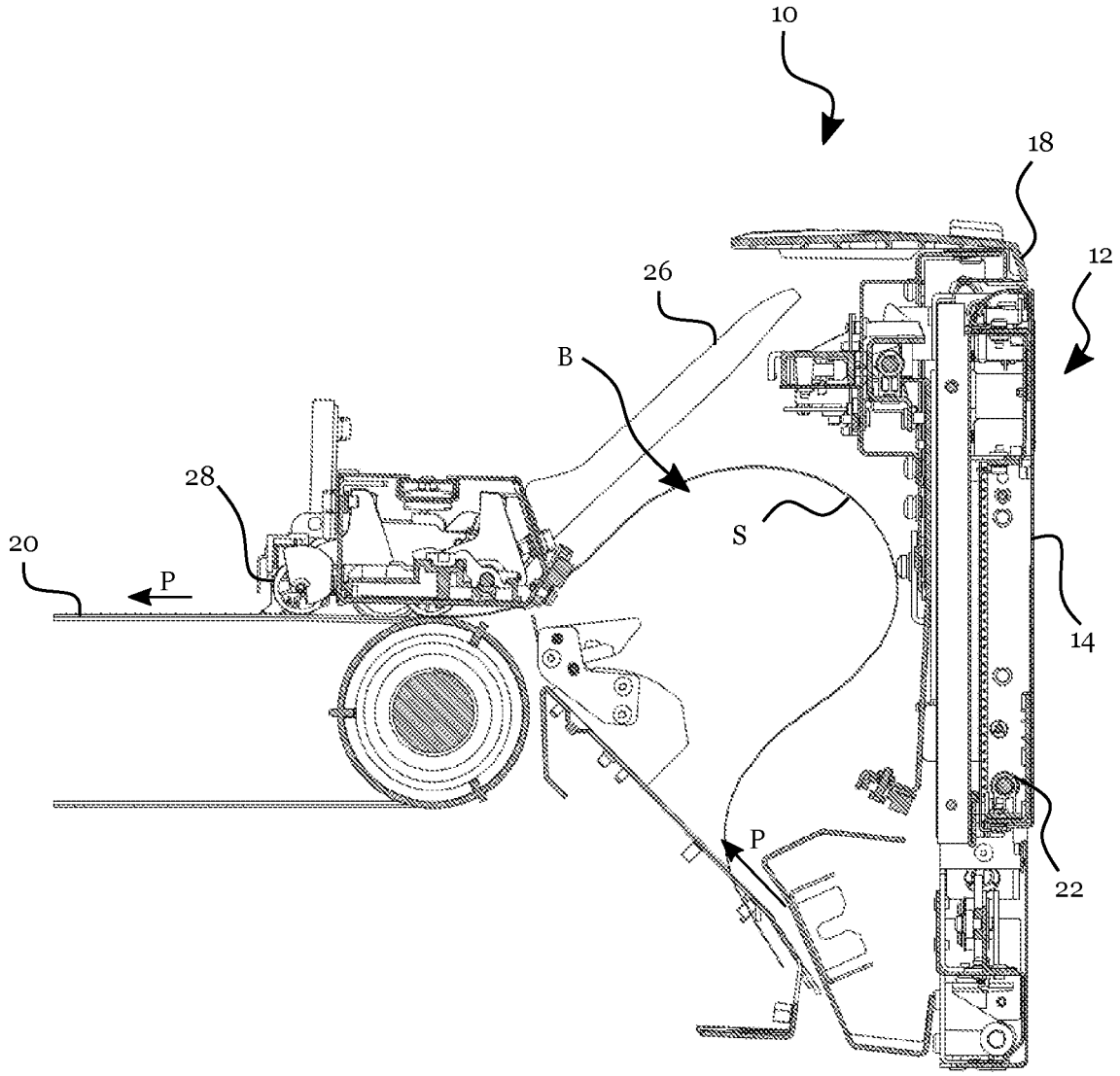
FIG. 2 illustrates a printer with a media bypass in an inactive configuration according to an example.

FIG. 2 illustrates a sectional view of a printer 10 with a media bypass 12 according to another example. The media bypass 12 is in the inactive configuration, such that a convertible media support 14 of the media bypass 12 defines a periphery of the printer 10, i.e. by substantially extending the periphery of the printer 10 defined by a frame 18 of the printer 10.

The printer 10 comprises an internal media supply (not shown) to supply a flexible substrate S from a roll into a media path P and may comprise a cutter (not shown) to cut the flexible substrate S. To enable the printer 10 to cut the substrate S supplied from the roll in the internal media supply while printing, the printer 10 may comprise a buffer zone B in the media path P upstream of the printhead 16 to create a buffer of the substrate S. Hence, the printer 10 may print on the substrate S supplied from the buffer while the cutter may cut the substrate S with the substrate S being stationary in the cutter.

To create a buffer of the substrate S in the buffer zone B, the acceleration and/or feed velocity of the substrate S may be greater than a media advance speed in the print zone Z. For example, a feed mechanism coupled to the internal media supply may accelerate the printable medium P to a feed velocity which is larger than the drag velocity of the conveyor belt 20. The substrate S may be held on the conveyor belt 20 by rollers 28, a suction force applied to the conveyor belt 20, or clamping elements, such that the media advance speed of the substrate S past the printhead 16 is fixed to the speed of the conveyor belt 20. Accordingly, a buffer may be formed upstream of the conveyor belt 20.

A pivotable arm 26 may pivot to control a shape of the buffer of the flexible substrate S, such that the substrate S buckles upward into the buffer zone B, when the speed of the conveyor belt 20 is smaller than the feeding velocity of the substrate S from the internal media supply. The buffer zone B may occupy a space facing the media bypass 12 in the inactive configuration, and the conveyor belt 20 may accordingly be spaced from the media bypass 12 by the buffer zone B.

Figure 3:
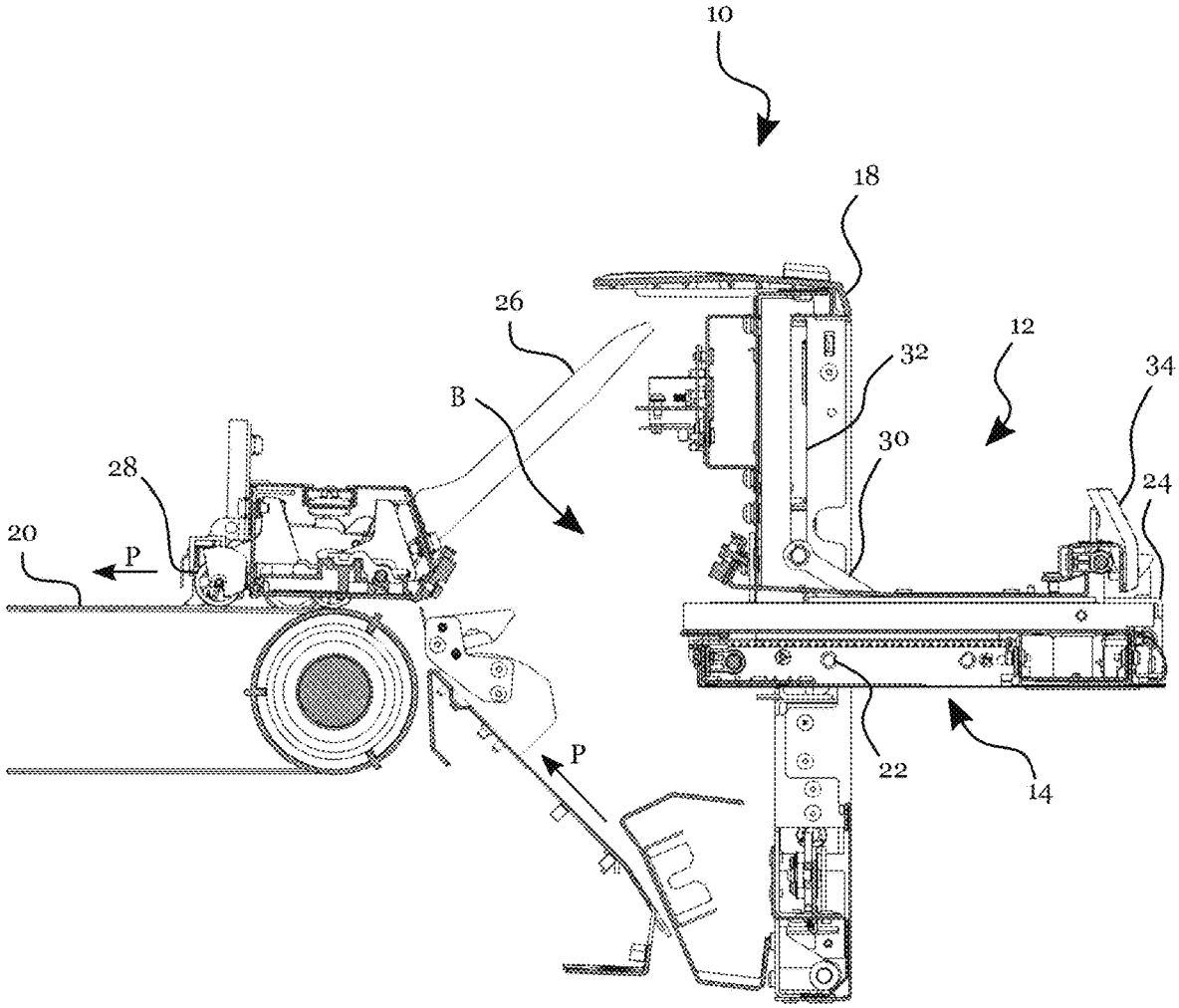
FIG. 3 illustrates a printer with a media bypass in an active configuration according to an example.

FIG. 3 illustrates another sectional view of a printer 10 similar to the printer 10 of FIG. 2 with a media bypass 12 according to another example. In FIG. 3, the convertible media support 14 of the media bypass 12 is pivoted towards an active configuration around the pivot point 22, such that the convertible media support 14 extends into the printer 10.

A portion of the convertible media support 14 may protrude out from the periphery of the printer 10, such as to receive a substrate S, R on an outer edge 24 of the convertible media support 14 lying outside of the printer 10.

The convertible media support 14 may be supported by a supporting arm 30 with one side pivotally coupled to the convertible media support 14 and the opposite side being coupled to the printer 10 in a movable fashion. A guiding slot 32 may restrict the motion of a mounting point of the supporting arm 30 to the printer 10 and may guide the mounting point along a linear path while the convertible media support 14 pivots from the inactive configuration towards the active configuration. The mounting point of the supporting arm 30 may abut against an end of the guiding slot 32 when the convertible media support 14 is in a horizontal position and the supporting arm 30 may support the convertible media support 14 in the active configuration. A damping or biasing mechanism may be integrated with the guiding slot 32 to dampen a pivoting motion of the convertible media support 14 or to bias the convertible media support 14 towards the inactive position.

After pivoting around the pivot point 22, the convertible media support 14 may be substantially parallel with respect to a media path P past the print zone Z, e.g. may extend parallelly with respect to an upper surface of the conveyor belt 20 facing the printhead 16.

As illustrated in FIG. 3, the convertible media support 14 may extend into the buffer zone B of the printer 10, and may occupy a portion of the path traversed by the pivotable arm 26, and the printer 10 may retract the pivotable arm 26, such as to not interfere with the media bypass 12.

The convertible media support 14 may at least partially bridge a distance between the periphery of the printer 10 and an internal media transport mechanism of the printer 10, e.g. the conveyor belt 20, after pivoting towards the active configuration. In some examples, the convertible media support 14 extends towards the conveyor belt 20, such that a projection of its media supporting surface crosses a curving section of the conveyor belt 20 facing the media bypass 12 or coincides with the upper surface of the conveyor belt 20 facing the printhead 16. Hence, the convertible media support 14 may guide the substrate S, R from the outer edge 24 onto an internal transport mechanism of the printer 10.

To reduce a distance between the convertible media support 14 and the conveyor belt 20, the convertible media support 14 may be telescopically extendable to extend further into the printer 10, e.g. by actuating a handle 34 of the media bypass 12 and pushing a telescopically extendable portion of the convertible media support 14 into the printer 10.

Figure 4:
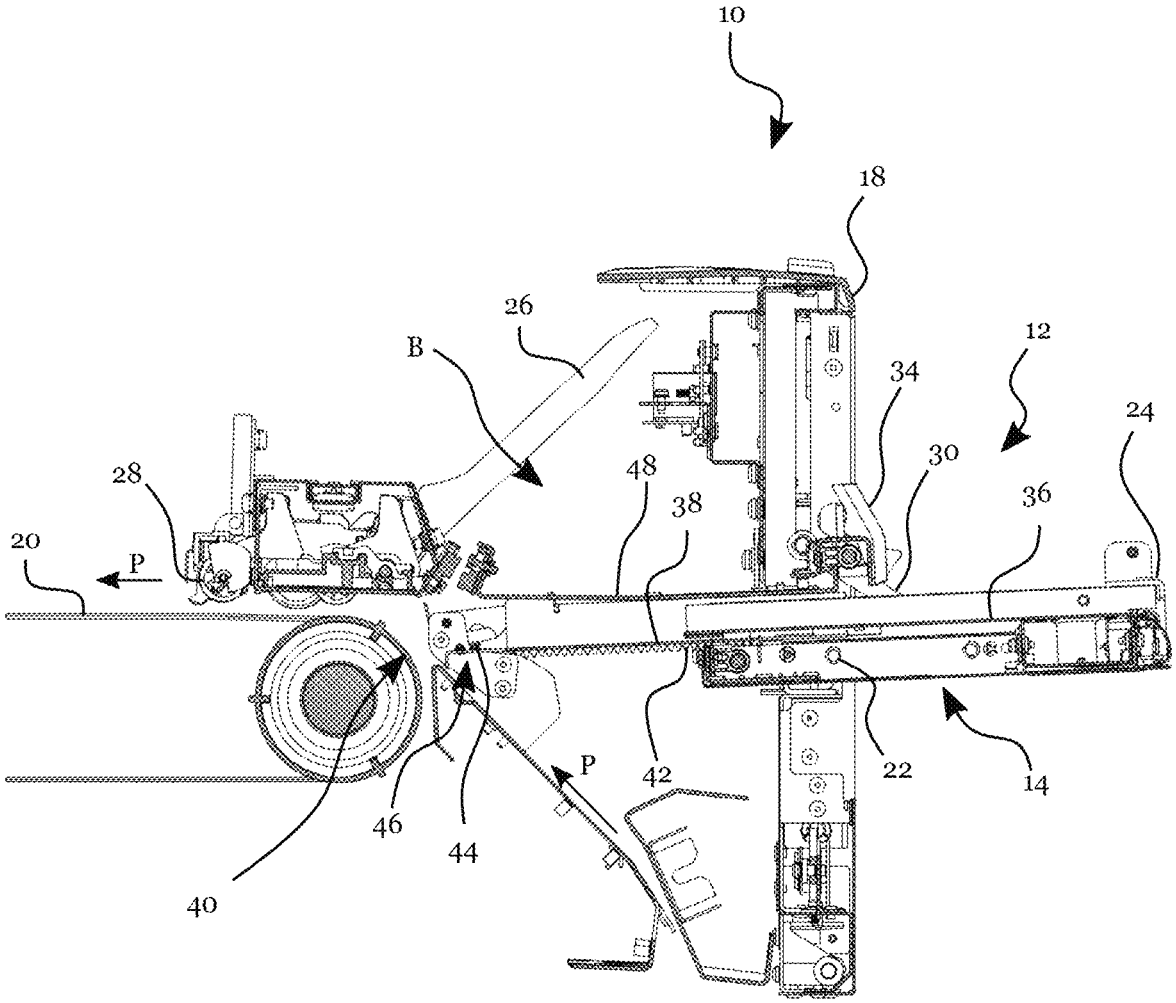
FIG. 4 illustrates a printer with a media bypass in a telescopically extended configuration according to an example.

FIG. 4 illustrates another sectional view of a printer 10 similar to the printer 10 of FIG. 3 with a media bypass 12 according to an example. The convertible media support 14 has been pivoted towards the active configuration and telescopically extends into the printer 10. As can be seen from FIG. 4, the convertible media support 14 comprises a pivoting input tray 36 pivotally coupled to the pivot point 22 and a bridging support 38. The bridging support 38 is telescopically extendable along the pivoting input tray 36 to extend into the printer 10, when the pivoting input tray 36 is pivoted towards the active configuration. To move the convertible media support 14 towards the active configuration, an operator may pivot the pivoting input tray 36 towards the active configuration, and the bridging support 38 may pivot with the pivoting input tray 36 to be subsequently extended along the pivoting input tray 36 towards a curving section 40 of the conveyor belt 20.

The bridging support 38 may comprise racks of teeth 42 on lateral sides of the bridging support 38 which may be coupled to wheels (not shown) of the pivoting input tray 36, or vice-versa, such that a motion of the lateral sides of the bridging support 38 along the telescopic extension direction may be synchronized by the wheel. For example, a rotatable shaft may extend between the lateral sides of the pivoting input tray 36 and wheels may be mounted on the shaft on opposite sides of the pivoting input tray 36 to synchronize a telescopic extension of opposite sides of the bridging support 38 by a form locking with the racks of teeth 42 on either side of the bridging support 38.

The bridging support 38 may feature an engaging pin 44 to engage with a supporting bracket 46 of the printer 10 when the convertible media support 14 is telescopically extended. The supporting bracket 46 may hold the convertible media support 14 in an inclined position via the pin 44, such that the convertible media support 14 extends downwards into the printer to passively guide a substrate S, R placed on the convertible media support 14 into the printer 10 based on its own weight. The substrate S, R may be guided towards the curving section 40 of the conveyor belt 20, such that the substrate S, R may be pulled onto the conveyor belt 20 and past the printhead 16 when the substrate S, R is supplied via the convertible media support 14. In other words, the media support rigid 14 may telescopically extend towards the conveyor belt 20 to guide the externally supplied substrate S, R onto the conveyor belt 20.

In the extended configuration, the telescopic movement of the bridging support 38 may be locked, such that the bridging support 38 may not be inadvertently retracted towards the pivoting support tray 36. For example, a locking mechanism may lock the relative positions of the pivoting support tray 36 and the bridging support 38 when the bridging support 38 is fully extended, and an operator may actuate a release actuator (e.g. the handle 34) or overcome a holding force to again retract the bridging support 38. In some examples, the supporting bracket 46 features an accommodating recess for receiving the pin 44, such that the bridging support 38 is held in the extended position by a force- or form-locking engagement between the pin 44 and the supporting bracket 46.

The bridging support 38 may be arranged below the pivoting input tray 36 to allow a substrate S, R to slide from the pivoting input tray 36 downwards onto the bridging support 38 to guide the substrate S, R into the printer 10. In some examples, the convertible media support 14 does not feature upward steps or elongated recesses along a lateral direction, such as to not obstruct a sliding of the substrate S, R into the printer 10.

The convertible media support 14 may further comprise an upper restriction 48 to restrict a path of the substrate S, R entering the printer 10 via the media bypass 12 to a channel. The upper restriction 48 may be connected to the bridging support 38, such as to telescopically extend with the bridging support 38 into the printer 10. In addition, the upper restriction 48 may be inclined with respect to a media supporting surface of the pivoting input tray 36 and the bridging support 38, such that a rigid substrate R supported on the outer edge 24 of the convertible media support 14 may be suspended between the outer edge 24 of the convertible media support 14 and the conveyor belt 20 on a linear path without interfering with the upper restriction 48. In some examples, the upper restriction 48 may prevent a rigid substrate R of a predetermined thickness from pivoting away from the conveyor belt 20. The upper restriction 48 may further prevent a flexible substrate S from collapsing or bending out of the media path P. In other words, the upper restriction may define an upper boundary of the media path P for rigid or flexible substrates S, R externally supplied via the media bypass 12 towards the internal media transport mechanism.

As in the example of FIG. 1, the vertical position of the conveyor belt 20 may be adjusted, to accommodate substrates S, R with a range of different thicknesses. In some examples, when the bridging support 38 is telescopically extended and the pin 44 engages the supporting bracket 46 of the printer 10, the outer edge 24 of the convertible media support 14 may be aligned, such that a rigid substrate R of a predetermined thickness may be level with the upper surface of the conveyor belt 20 facing the printhead 16. For example, when the vertical position of the conveyor belt 20 is adjusted for substrates S, R with a thickness of 5 mm, the projection of the upper surface of the conveyor belt 20 may be aligned with the outer edge 24 of the convertible media support 14.

In some examples, the upper restriction 48 is inclined, such that when the conveyor belt 20 is in a vertical position for receiving substrates S, R with the predetermined thickness, the upper restriction 48 does not obstruct the path of the substrate S, R from the outer edge 24 of the convertible media support 14 towards an upper edge of the conveyor belt 20 facing the media bypass 12 or such that the upper restriction 48 extends parallelly with respect to the linear path from the outer edge 24 towards the print zone Z.

For common substrates S, R which are thinner than 5 mm the substrate S, R may generally be sufficiently flexible, such that a shape of the substrates S, R may adjust to an imposed media path P imposed by the conveyor belt 20. For example, rollers 28 may push the (thin) substrate S, R onto the conveyor belt 20 or suction mechanisms associated with the conveyor belt 20 may hold the substrate S, R against a surface of the conveyor belt 20, such that the substrate S, R may be moved past the printhead 16 while being substantially parallel to a path of the conveyor belt 20.

To accommodate substrates S, R which are thicker than a predetermined thickness, e.g. about 5 mm, the media bypass 12 may adjust a vertical position of the outer edge 24, such that the substrate S, R may be level with respect to the portion of the media path P past the printhead 16, when the rigid substrate R is supported on the outer edge 24 of the convertible media support 14 and on the conveyor belt 20. For example, the convertible media support 14 may be vertically displaced or may be pivoted to adjust a vertical position of the outer edge 24 of the convertible media support 14.

Figure 5:
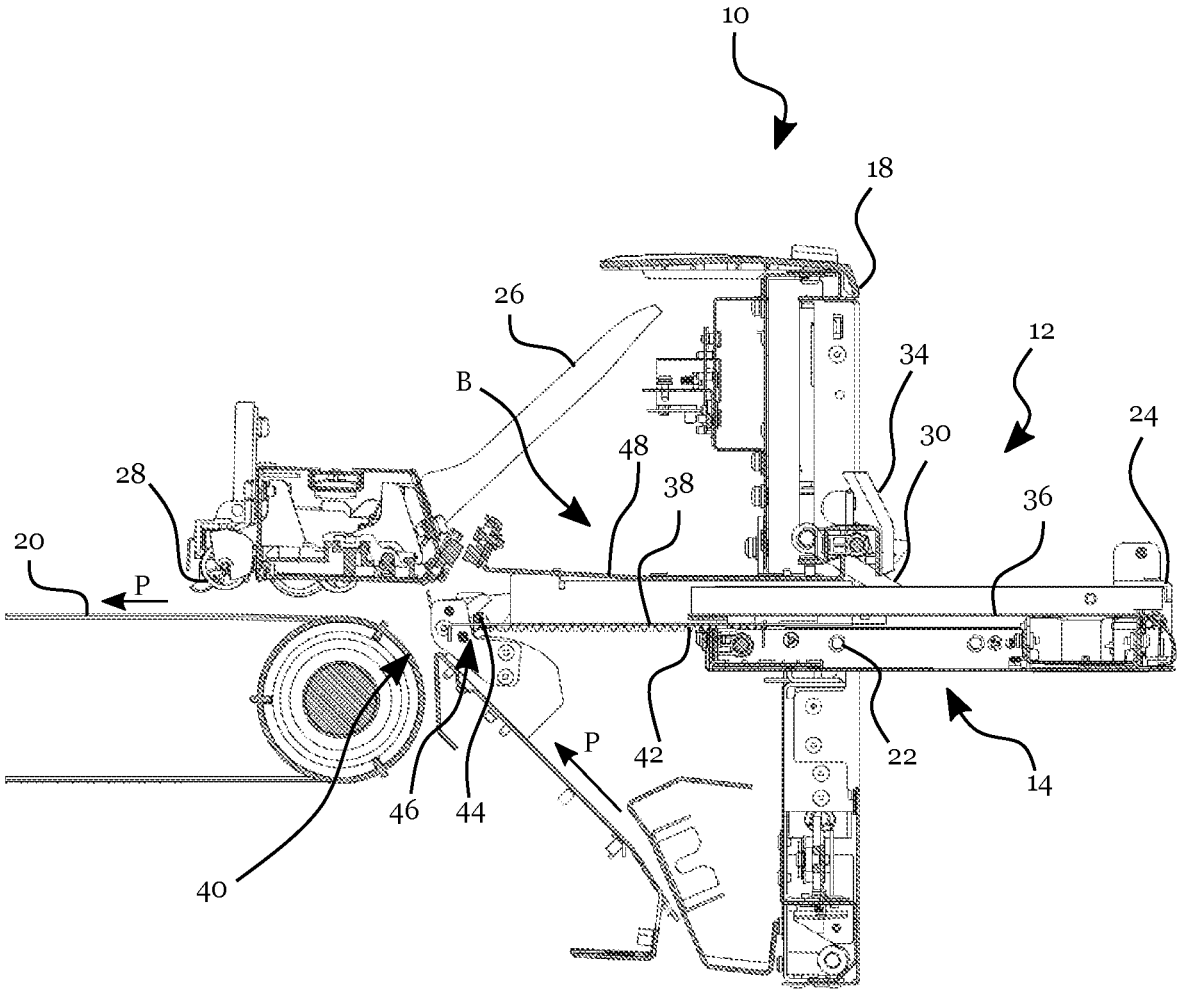
FIG. 5 illustrates a printer with a media bypass in a telescopically extended configuration according to another example.

FIG. 5 illustrates another sectional view of a printer 10 similar to the printer 10 of FIG. 4 with a media bypass 12 according to an example. A convertible media support 14 of the media bypass 12 is pivoted towards the active configuration and is telescopically extended, such that a pin 44 of a bridging support 38 of convertible media support 14 engages a supporting bracket 46 of the printer 10.

However, with respect to the printer 10 of FIG. 4, in FIG. 5 the conveyor belt 20 is adjusted towards a vertical position for printing on substrates S, R with a maximum thickness supported by the printer 10, e.g. about 10 mm, and the convertible media support 14 is pivoted to be substantially parallel with respect to the upper surface of the conveyor belt 20 facing the printhead 16. As a result, the outer edge 24 of the convertible media support 14 is aligned with the upper surface of the conveyor belt 20, such that that a substrate S, R with the maximum thickness may be level with respect to the portion of the media path P past the printhead 16, when the substrate S, R is supported on the outer edge 24 of the convertible media support 14 and on the conveyor belt 20.

The convertible media support 14 may be pivoted by driving an actuator coupled to the convertible media support 14 or the supporting bracket 46 to selectively adjust an inclination of the convertible media support 14. For example, the convertible media support 14 may be selectively rotated in accordance with a vertical position of the conveyor belt 20, such that a rigid substrates R of a given thickness may be level with respect to the portion of the media path P past the printhead 16, when the rigid substrate R is supported on the outer edge 24 of the convertible media support 14 and on the conveyor belt 20.

In some examples, the convertible media support 14 is biased, e.g. by an elastic biasing element, towards an inclined configuration and is pivoted to accommodate a thicker substrate S, R based on a weight of the substrate S, R acting on the outer edge 24 of the convertible media support 14. In other words, the convertible media support 14 may pivot from a first configuration towards a second configuration when the weight of the substrate S, R exceeds a weight threshold.

For example, the pivot point 22 and the center of mass of the convertible media support 14 in the telescopically extended configuration may be offset such that a weight of the portion of the rigid media bypass 14 extending into the printer 10 corresponds to a counterweight for substrates S, R of a predefined weight, and the convertible media support 14 may pivot from the first configuration towards the second configuration when the weight of the substrate S, R is greater than the counterweight.

In some examples, the convertible media support 14 comprises additional weights, such as exchangeable weights, to define the weight threshold for pivoting from the first configuration towards the second configuration.

In some examples, the supporting bracket 46 comprises an elastic biasing element to bias the convertible media support 14 towards a first inclined configuration, and the biasing force may be selected, such that substrates S, R supported on the outer edge 24 and exceeding the predetermined thickness exert a torque onto the convertible media support 14 which overcomes the biasing force of the biasing element, such that the convertible media support pivots towards the second configuration. In some examples, the convertible media support 14 is level with respect to the print zone Z, i.e. with respect to the supporting structure supporting the substrate S, R while passing the printhead 16, in the second configuration.

The inventors found that rigid substrates S, R with a thickness between 5 mm and about 9 mm are generally uncommon for use with printers 10. Hence, a force threshold may be selected, e.g. via the biasing element, which prevents the convertible media support 14 from pivoting when common substrate types with a thickness of 5 mm or less are supported on the outer edge 24, but which allows the convertible media support 14 to pivot in response to thicker substrates S, R being supported on the outer edge 24.

Figure 6A:
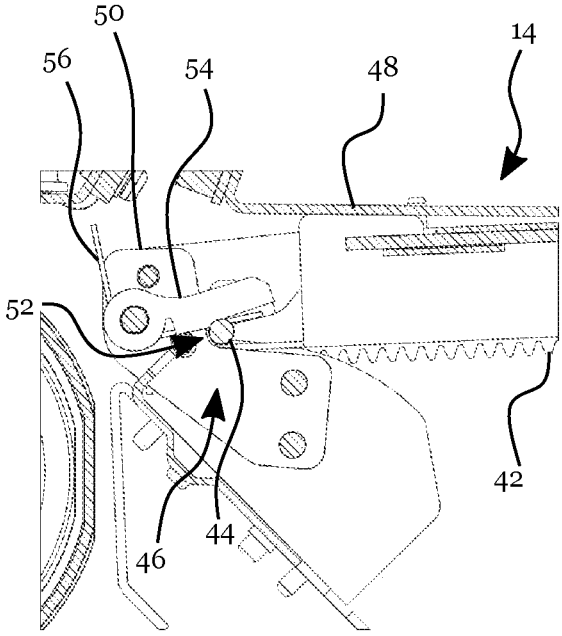
FIG. 6A, 6B illustrate detail views of an engagement between a supporting bracket of a printer and a pivotable convertible media support according to an example.
Figure 6B:
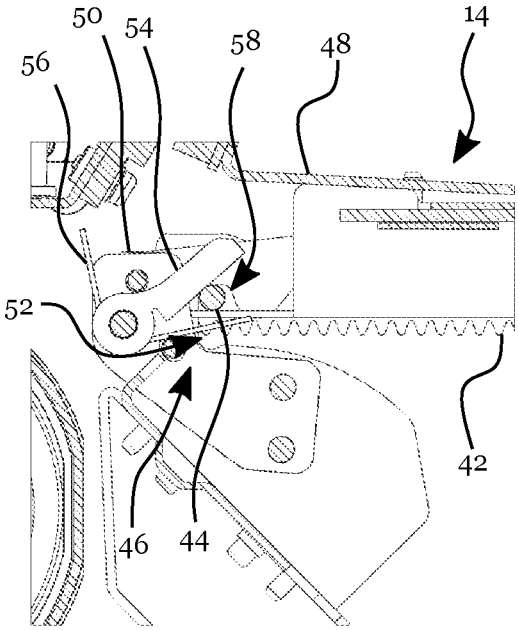

FIG. 6A, 6B illustrate detail views of an engagement between a supporting bracket 46 of a printer 10 and a pivotable convertible media support 14 in a first configuration and a second configuration, respectively, according to examples. The supporting bracket 46 comprises a bracket body 50 featuring a slot 52, and a pivotable lever 54 coupled to the bracket body 50 via an elastic biasing element 56, e.g. a torsion coil spring, to bias the pivotable lever 54 towards a lower portion of the bracket body 50. The pivotable lever 54 engages the pin 44 of the convertible media support 14 to exert a torque onto the convertible media support 14 and to bias the convertible media support 14 towards an inclined configuration.

In FIG. 6A, the pivotable convertible media support 14 is in the first inclined configuration, such that the pin 44 of the pivotable convertible media support 14 rests in the bottom section of the slot 52. The pivotable lever 54 engages the pin 44 and presses the pin 44 against the lower portion of the bracket body 50 to hold the convertible media support 14 in an inclined position.

In FIG. 6B, the convertible media support 14 is in the second configuration, such that the pin 44 is moved upwards along the slot 52 of the supporting bracket 46 while pivoting the pivotable lever 54 against the force of the elastic biasing element 56 to abut against an upper portion of the bracket body 50.

The slot 52 may feature an upper recess 58, such that the pin 44 may be prevented from retracting out of the slot 52 in the second configuration. Hence, the convertible media support 14 may be held in the supporting bracket 46 and prevented from retracting also in a substantially horizontal position, when the convertible media support 14 may not be biased into the supporting bracket 46 by its own weight.

The biasing force of the elastic biasing element 56 may be selected, such that common rigid or flexible substrates S, R with a thickness greater than 5 mm which are supported by the convertible media support 14 may exert a torque onto the convertible media support 14 which is greater than the torque exerted by elastic biasing elements 56. Hence, when rigid or flexible substrates S, R with a thickness greater than 5 mm are supported on the outer edge 24 of the convertible media support 14, the convertible media support 14 may be pivoted from the first configuration towards the second configuration.

An operator or external media feeding mechanism may also engage the outer edge 24 of the convertible media support 14 to pivot the convertible media support in accordance with a media thickness.

In some examples, the pivotable lever 54 is coupled to an actuator (not shown), and the pivotable lever 54 may be released or selectively pivoted by driving the actuator.

In some examples, a center of mass of the convertible media support 14 is close to the pivot point 22 in the telescopically extended configuration of the convertible media support 14, such that the biasing force of the biasing element may be comparatively low with respect to a weight of the convertible media support 14. For example, the torque generated by the weight of the convertible media support 14 in the telescopically extended configuration may be smaller than the torque exerted by the lever 54 onto the convertible media support 54.

Accordingly, in the active configuration the inclination of the convertible media support 14 may be controlled with simple technical means through variable attachment points of the convertible media support 14 to the supporting bracket 46, resulting in a versatile media bypass 12.

Figure 7:
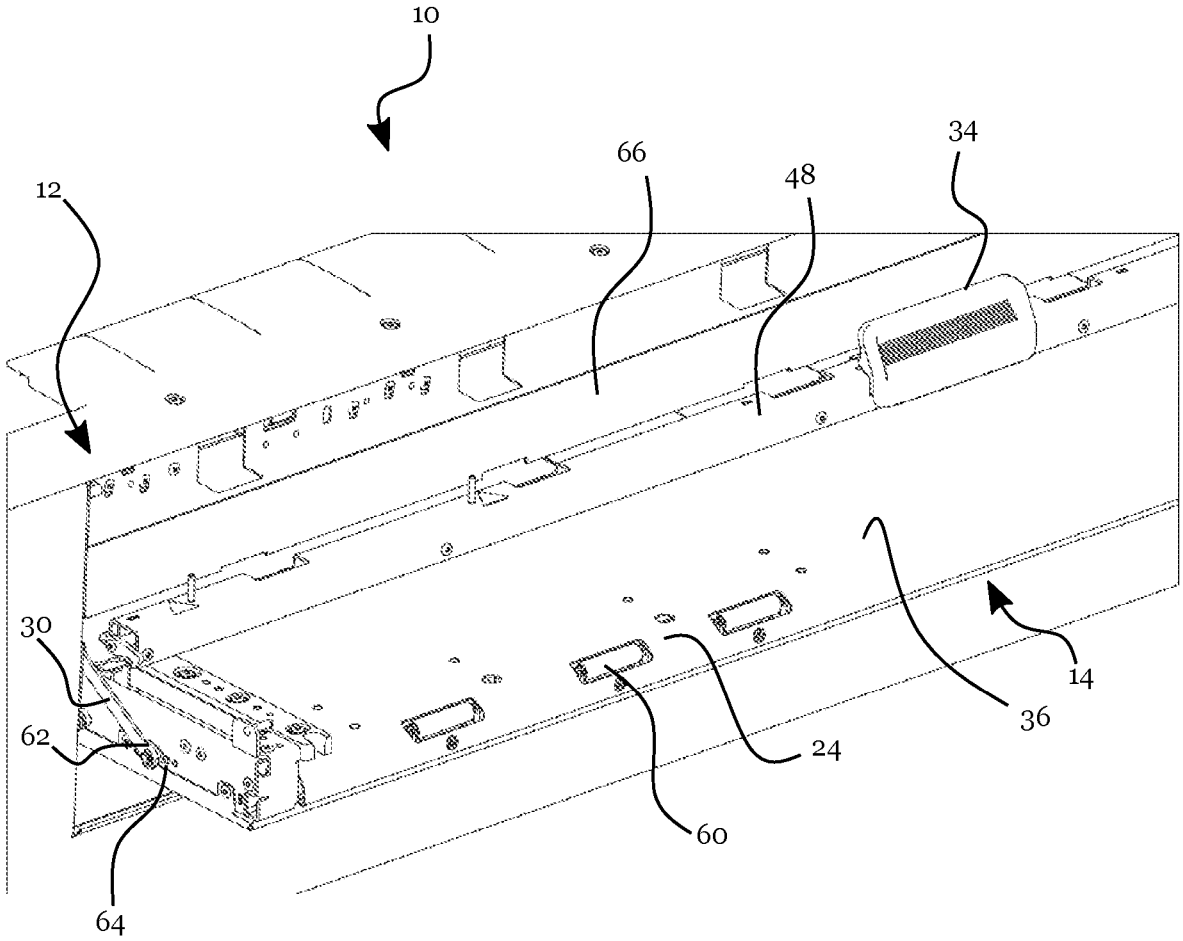
FIG. 7 illustrates a front view of a printer with a media bypass according to an example.

FIG. 7 illustrates a front view of a printer 10 with a media bypass 12 according to an example. A convertible media support 14 of the media bypass 12 is in an active configuration and provides a substantially flat media path to guide a substrate S, R into the printer 12 between an upper surface of a pivoting input tray 36 and an upper restriction 48. As is further visible in FIG. 7, the outer edge 24 may feature rollers 60 to reduce a friction of a substrate S, R supported on the outer edge 24 of the convertible media support 14.

In some examples, the convertible media support 14 comprises a latching mechanism to prevent the convertible media support 14 from pivoting towards the inactive configuration, when the convertible media support 14 is telescopically extended. Accordingly, the convertible media support 14 may not inadvertently pivot towards the inactive configuration, e.g. when the center of mass of the convertible media support 14 is close to the pivot point 22 in the telescopically extended configuration of the convertible media support 14.

For example, as shown in FIG. 7, the convertible media support 14 can be supported in the active configuration by a supporting arm 30 which may engage with a latching mechanism of the media bypass 12 to prevent inadvertent pivoting towards the inactive configuration. The supporting arm 30 may feature a protrusion 62 at the mounting point to the convertible media support 14 to abut against a pin 64 (shown in a retracted configuration) when the convertible media support 14 is telescopically extended into the printer 10.

The pin 64 may be biased by a biasing element and may be coupled to the convertible media support 14, such that, when the convertible media support 14 is telescopically extended into the printer 10, the pin 64 may protrude from the convertible media support 14 to abut against the protrusion 62 of the supporting arm 30 and to prevent a rotation of the supporting arm 30, thereby holding the convertible media support 14 in the active configuration. The pin 64 may be internally coupled to retraction mechanism with a slanted surface (not shown) to engage with a protrusion (not shown) of a telescopically extendable bridging support 38, such as to passively retract the pin 64 into the convertible media support 14 when the bridging support 38 is retracted.

Hence, the convertible media support 14 may be prevented from pivoting towards the inactive configuration via the engagement of the pin 64 and the supporting arm 30 when the convertible media support 14 is telescopically extended, but may be pivotable, when the convertible media support 14 is retracted.

In other words, a media bypass 12 of a printer 10 may comprise a pivotable media support 14 to pivot between an active configuration and an inactive configuration, wherein the pivotable media support 14 may be telescopically extendable into the printer 10 in the active configuration, and the media bypass 12 may further comprise a latching mechanism to prevent the pivotable media support 14 from pivoting from the active configuration towards the inactive configuration when the pivotable media support 14 is telescopically extended in the active configuration. The latching mechanism may comprise a blocking pin 64 mechanically coupled to a telescopic extension mechanism of the pivotable media support 14, such that the blocking pin 64 engages with a protrusion 62 of the media bypass 12 to prevent the pivotable media support 14 from pivoting towards the inactive configuration, when the pivotable media support 14 is telescopically extended into the printer 10.

A wall 66 may prevent inadvertent access to the internal elements of the printer 10 when the convertible media support 14 is pivoted towards the active configuration, such as to prevent damage to the printer 10 or to reduce a risk of inadvertent injury to an operator through incorrect operation.

Hence, the printer 10 with the media bypass 12 may enable a simple method of providing rigid or flexible external substrates S, R towards a print zone Z of the printer 10.

In some examples, the method of providing a (rigid) substrate S, R to the printer 10 through a media bypass 12 comprises pivoting a substrate support 14 from an inactive configuration, in which the substrate support 14 defines a portion of the periphery of the printer 10, towards an active configuration, wherein the substrate support 14 extends into the printer 10 towards an intermediate section of a media path P for supplying a substrate S from an internal media supply towards a printhead 16. The method may further comprise telescopically extending the substrate support 14 in the active configuration into the printer 10, e.g. towards the intermediate section of the media path P. The method may comprise engaging a pin 44 of the substrate support 14 with a supporting bracket 46 of the printer 10 for controlling an inclination of the substrate support 14 with respect to the printer 10. The method may further comprise supporting an externally supplied substrate S, R on an outer edge 24 of the substrate support 14, and guiding the substrate S, R into the printer 10 along the extension of the substrate S, R.

Accordingly, the media bypass 12 may be simple in operation and enable printing on a plurality of different flexible or rigid substrates S, R via the media bypass 12.

In some examples, the media bypass 12 may be integrated with a jam access door of the printer 10 to enable access to the internal elements of the printer 10 at the location of the media bypass 12 without increasing a footprint of the printer 10. For example, the convertible media support 14 may be inset into a pivotable door of the printer 10, and the convertible media support 14 may pivot outwards together with the pivotable door to enable access to the interior of the printer 10, e.g. access to the buffer zone B or access to the media path P towards the printhead 16.

Figure 8A:
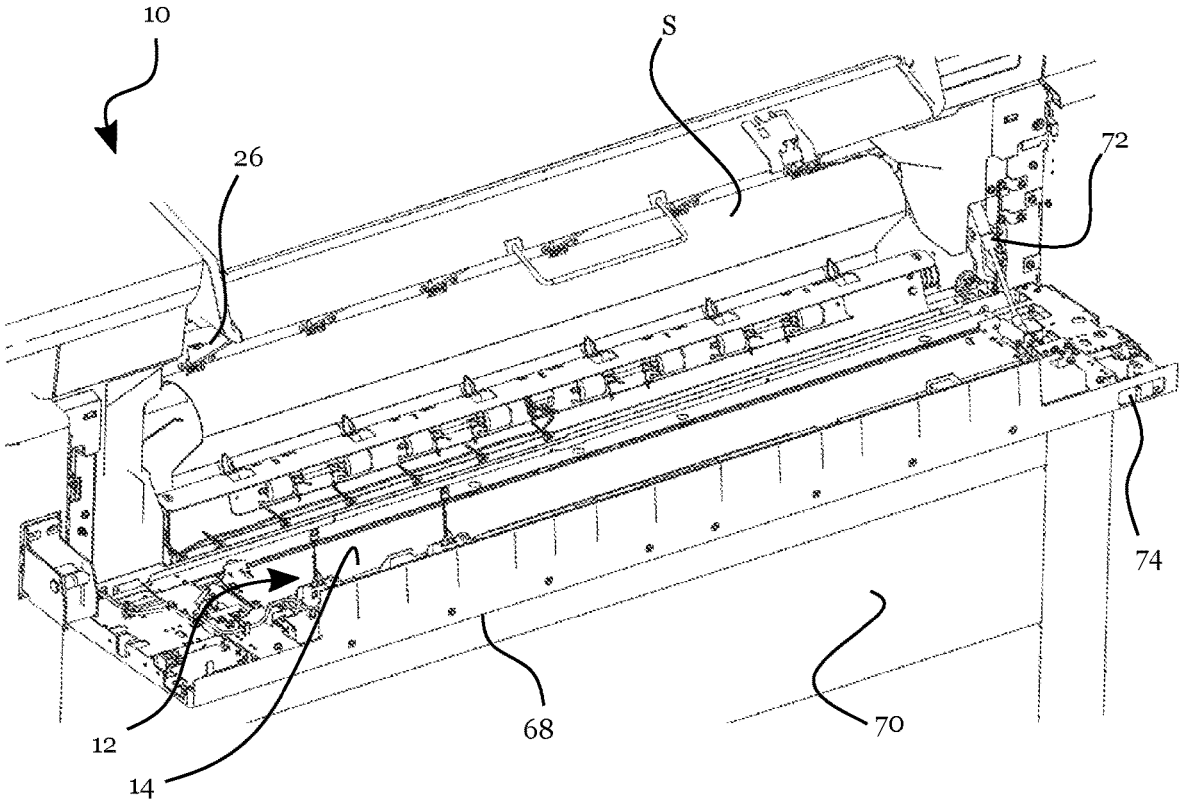
FIG. 8A illustrates a printer with a pivotable door according to an example.

FIG. 8A illustrates a printer 10 with a pivotable door 68 according to an example. The pivotable door 68 may be a jam access door of the printer 10, and may be arranged next to access doors 70 for accessing internal media supplies in the printer 10 or other portions of the media path P. The pivotable door 68 may pivot around a pivot point located at its lower edge, and a pivoting motion of the pivotable door 68 may be damped by a linear damper 72 to limit a pivoting speed of the pivotable door 68. Hence, an operator may pivot the pivotable door 68 outward from the printer 10 to access the interior of the printer 10, such as to resolve a jam of the substrate S in the printer 10.

A convertible media support 14 of a media bypass 12 may be inset into the pivotable door 68, and the pivotable door 68 may house components of the media bypass 12 for controlling a pivoting of the convertible media support 14 with respect to the pivotable door 68 or the printer 10. Hence, the media bypass 12 may pivot together with the pivotable door 68, when an operator accesses the interior of the printer 10.

The pivoting motion of the pivotable door 68 may be selectively prevented by a locking mechanism (not shown), which may be actuated via a locking switch 74. The locking switch 74 may actuate a locking pin (not shown) of the locking mechanism to hold the pivotable door 68 in a closed, vertical position. In addition, passive retaining mechanisms, such as magnets, may be provided in the printer 10 to hold the pivotable door 68 in its closed, vertical position independently of the state of the locking mechanism with a predetermined holding force, such as between 10 N to 100 N, e.g. 30 N.

In some examples, the locking switch 74 is switched between a first configuration and a second configuration to prevent relative movement between the printer 10 and the pivotable door 68 in the first configuration and to prevent relative movement between the pivotable door 68 and the convertible media support 14 in the second configuration.

In other words, the locking mechanism may alternatively prevent relative motion between the printer 10 and pivotable door 68 or between the pivotable door 68 and the convertible media support 14.

In some examples, the locking mechanism prevents opening the pivotable door 68 when the convertible media support 14 is pivoted towards the active configuration. For example, when the convertible media support 14 leaves the inactive configuration, a blocking pin may prevent operation of the locking mechanism by an operator. Accordingly, damage to printer components or inadvertent injury of an operator may be prevented.

In some examples, the locking switch 74 is coupled to a first locking pin and a second locking pin arranged on opposite lateral sides of the pivotable door 68 and drives a motion of the first locking pin and the second locking pin in opposite directions. Accordingly, the pivotable door 68 and the convertible media support 14 may be supported on opposite sides, such as to prevent torsional stress on the pivotable door 68 or the convertible media support 14.

Figure 8B:
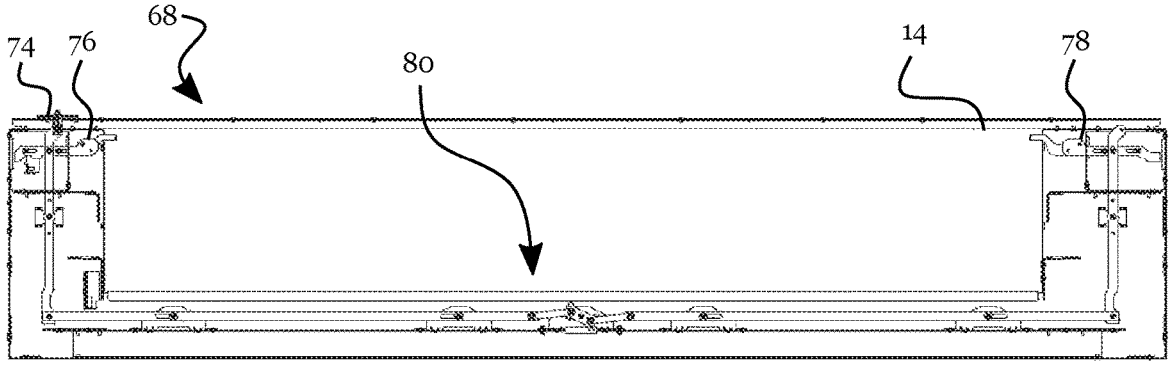
FIG. 8B illustrates a sectional view of a pivotable door comprising a convertible media support inset into the pivotable door according to an example.

FIG. 8B illustrates an example of a pivotable door 68, comprising a convertible media support 14 inset into the pivotable door 68 and pivotally coupled to the pivotable door 68. The pivotable door 68 comprises a locking switch 74 coupled to a first locking pin 76 and to a second locking pin 78 arranged on opposite lateral side of the pivotable door 68. The motion of the first locking pin 76 and the second locking pin 78 can be coupled via a coupling mechanism 80, such that operating the locking switch 74 drives the first locking pin 76 and the second locking pin 78 in opposite directions. Hence, the first and second locking pins 76, 78 can be symmetrically driven to switch between first and second configurations of the locking mechanism to alternatively prevent pivoting of the pivotable door 68 or of the convertible media support 14 with respect to the pivotable door 68.

Figure 9A:
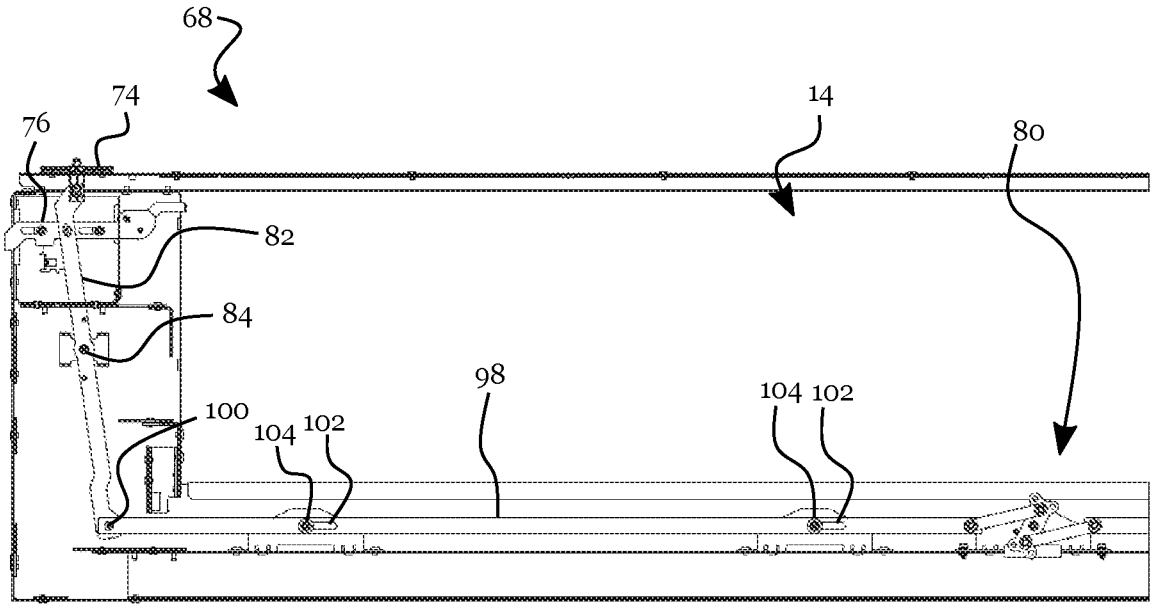
FIG. 9A and FIG. 9B illustrate sectional views of the left side of the example of a pivotable door in FIG. 8B in different configurations.
Figure 9B:
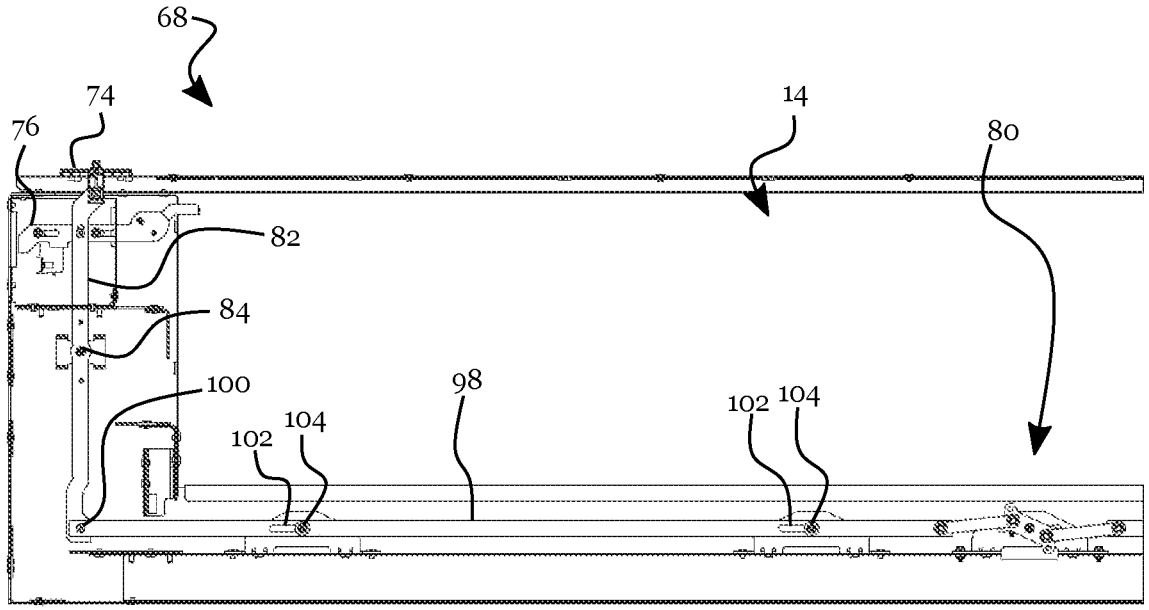
Figure 10A:
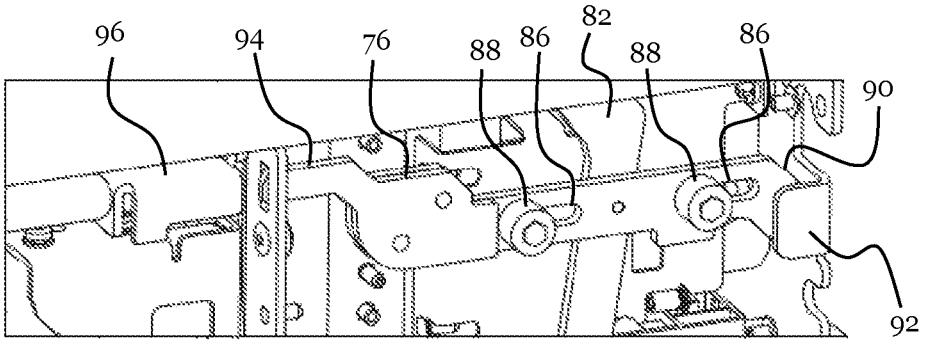
FIG. 10A and FIG. 10B illustrate detail views of the engagement positions of the locking pin in the examples of FIGS. 9A, 9B.
Figure 10B:
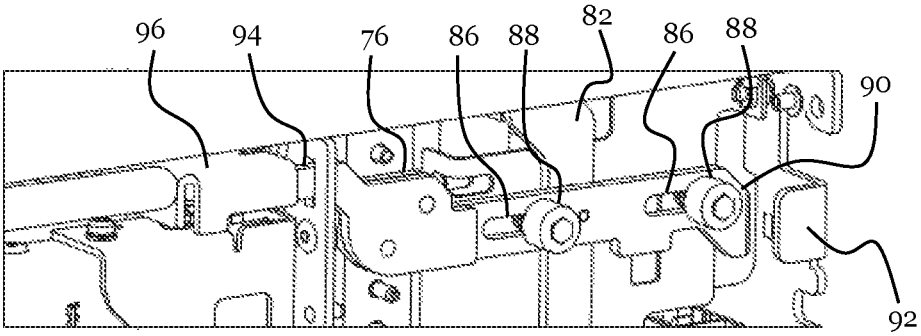
Figure 10C:
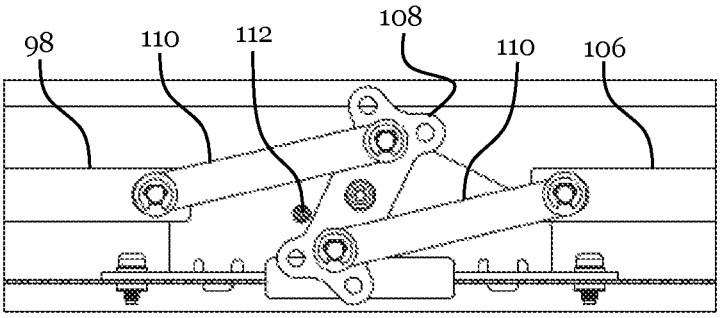
Figure 10D:
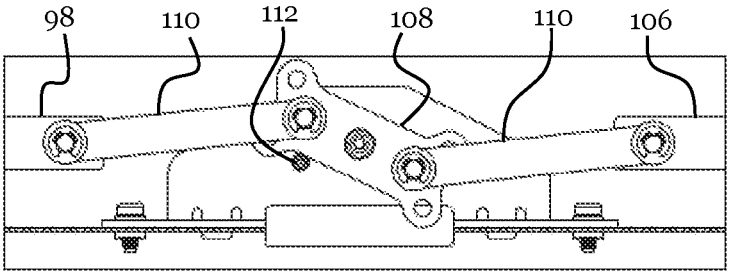

FIG. 9A and FIG. 9B illustrate sectional views of the left side of the example of a pivotable door 68 in FIG. 8B in the first configuration and in the second configuration, respectively. FIG. 10A and FIG. 10B illustrate corresponding detail views of the locking pin 76, while FIG. 100 and FIG. 10D illustrate corresponding detail views of the coupling mechanism 80 in the first configuration and in the second configuration, respectively.

The pivotable door 68 comprises the locking switch 74 arranged on an upper face of the pivotable door 68 to drive transitions between the first configuration and the second configuration of the locking mechanism. The locking switch 74 can be coupled to a pivotable bar 82, which is pivotally hinged on a pivot point 84 of the pivotable door 68 and which is further coupled to the first locking pin 76 with a swivel joint. Actuating the locking switch 74 may drive a pivoting motion of the pivotable bar 82 around the pivot point 84 to move the first locking pin 76 between the first configuration and the second configuration.

As illustrated in FIG. 10A, 10B, the locking pin 76 can comprise elongated slots 86 engaged by pins 88 of the pivotable door 68, such as to constrain a motion of the locking pin 76 along the elongated slots 86 in a substantially horizontal direction. In the first configuration illustrated in FIG. 10A, a first end 90 of the locking pin 76 may engage a bracket 92 of a printer frame 18 to prevent the pivotable door 68 from pivoting with respect to the printer frame 18. The opposite second end 94 of the locking pin 76 may be retracted from a bracket 96 of the convertible media support 14, such that the convertible media support 14 can be free to pivot with respect to the pivotable door 68.

In the second configuration illustrated in FIG. 10B, the locking pin 76 is shifted along the elongated slots 86 in the horizontal direction, such that the second end 94 of the locking pin 76 can engage the bracket 96 of the convertible media support 14 to prevent the convertible media support 14 from pivoting with respect to the pivotable door 68. The opposite first end 90 of the locking pin 76 can be retracted from the bracket 92 of the pivotable door 68, such that the pivotable door 68 may be free to pivot with respect to the printer frame 18.

To drive a motion of a second locking pin 78 on an opposite side of the pivotable door 68, the movement of the second locking pin 78 may be coupled to the movement of the first locking pin 76 via a mechanical coupling mechanism 80.

For example, the pivotable bar 82 may be coupled to a horizontally aligned transfer bar 98 located in the bottom of the pivotable door 68 via a swivel joint 100. The transfer bar 98 may be mounted to the pivotable door 68 via pins 104 received in horizontally elongated slots 102 of the transfer bar 98 to control a motion of the transfer bar 98. Pivoting the pivotable bar 82 may then drive a (horizontal) motion of the transfer bar 98 along the extension of the elongated slots 102.

As illustrated in FIGS. 100, 10D, the displacement of the transfer bar 98 may be transferred via the coupling mechanism 80 towards a corresponding transfer bar 106 coupled to the second locking pin 78, e.g. to drive an opposite displacement of the second locking pin 78 in a mirrored fashion. The coupling mechanism 80 may comprise a rotating rod 108 connected to the transfer bars 98, 106 on opposite sides of the rotating rod 108 via intermediate arms 110, the intermediate arms 110 connecting to the rotating rod 108 and the transfer bars 98, 106 via swivel joints. When one of the transfer bars 98, 106 is displaced horizontally, e.g. by actuating the locking switch 74, the intermediate arms 110 drive a rotation of the rotating rod 108. Accordingly, a movement of the (left) transfer bar 98 from the left to the right, e.g. when the locking mechanism switches between the first configuration towards the second configuration, induces a movement of the other (right) transfer bar 106 from the right to the left, and vice-versa.

In other words, the locking switch 74 may drive a displacement of the first locking pin 76 and the second locking pin 78 in opposite directions via a mechanical force inverting coupling mechanism 80 arranged in a bottom section of the pivotable door 68 and coupling the first locking pin 76 and the second locking pin 78.

By adjusting a vertical position of the pivot point 84, a relationship between the displacement distance of the locking switch 74 and the stroke of the transfer bar 98 may be adjusted, such as to adjust a force for displacing the locking pins 76, 78.

The coupling mechanism 80 may feature a blocking pin 112 to engage a flank of the rotating bar 108 when the locking mechanism is in the first configuration or in the second configuration for preventing further rotation of the rotating bar 108 or for preventing the rotating bar 108 from assuming a horizontal position. Hence, the displacement of the locking pins 76, 78 on opposite sides of the pivotable door 68 may be synchronized with simple technical means.

The skilled person will appreciate that other coupling mechanisms 80 than a stroke inverting coupling mechanism 80 based on a rotating rod may equally be employed in examples, e.g. by coupling transfer bars 98, 106 to opposite sides of a rotating gear with engaging teeth on the transfer bars 98, 106, or the like. In addition, locking pins 76, 78 on opposite lateral sides of the pivotable door 68 may also be coupled via a transfer and coupling mechanism in a top section of the pivotable door 68.

Hence, the media bypass 12 may be integrated into a rotatable (jam access) door 68 to enable service access to the interior of the printer 10 as well as selectively supplying external substrate S, R to the printer 10.

The invention claimed is:

1. A media bypass for a printer, the media bypass comprising:

a convertible media support to hold a substrate and to switch between an active and an inactive configuration, wherein the convertible media support pivots from the inactive configuration towards the active configuration to extend into the printer and to guide the substrate into the printer and wherein the convertible media support telescopically extends into the printer in the active configuration; and wherein the convertible media support comprises a latching mechanism to prevent the convertible media support from pivoting towards the inactive configuration, when the convertible media support is telescopically extended.

2. The media bypass of claim 1, wherein the convertible media support comprises a pivoting input tray and a bridging support, wherein the bridging support is telescopically extendable along the pivoting input tray to extend into the printer, when the pivoting input tray is pivoted towards the active configuration.

3. The media bypass of claim 2, wherein the bridging support is arranged below the pivoting input tray to allow a substrate to slide from the pivoting input tray downwards onto the bridging support to guide the substrate into the printer.

4. A media bypass for a printer, the media bypass comprising a convertible media support to hold a substrate and to switch between an active and an inactive configuration, wherein the convertible media support pivots from the inactive configuration towards the active configuration to extend into the printer and to guide the substrate into the printer; and the media bypass further comprising a pivotable door, wherein the convertible media support is inset into a pivotable door forming a periphery of a printer, and wherein the pivotable door is to pivot with respect to the printer, and wherein the pivotable door comprises a locking mechanism to prevent relative movement between the printer and the pivotable door in a first configuration and to prevent relative movement between the pivotable door and convertible media support in a second configuration.

5. The media bypass of claim 4, wherein the locking mechanism comprises a first locking pin arranged in the pivotable door and laterally movable to engage a slot in the convertible media support in the first configuration and to laterally protrude out from the pivotable door and away from the convertible media support when the locking mechanism is in the second configuration.

6. The media bypass door of claim 5, further comprising a second locking pin arranged on an opposite side of the pivotable door, wherein the second locking pin is coupled to the first locking pin via a rotating rod, and wherein the rotating rod rotates to drive the lateral movement of the first locking pin and the second locking pin in opposite directions.

7. A media input to supply a rigid substrate towards a printing zone of a printer, wherein the media input comprises a substrate support, wherein the substrate support is pivotally hinged to the printer at a pivot point, wherein the substrate support connects to a mounting element to supply the rigid substrate towards a printing zone of a printer in a first configuration and in a second configuration, and wherein the substrate support is to pivot from the first configuration towards the second configuration when the weight of the rigid substrate exceeds a weight threshold.

8. The media input of claim 7, wherein the substrate support is level with respect to the printing zone in the second configuration and inclined with respect to the printing zone in the first configuration.

9. The media input of claim 7, wherein the media input is to support rigid substrates on an outer edge of the substrate support in the first configuration, such that rigid substrates of a predetermined thickness are level with respect to the printing zone.

* * * * *